US010202897B2

(12) United States Patent
Sun et al.

(10) Patent No.: US 10,202,897 B2
(45) Date of Patent: Feb. 12, 2019

(54) SYSTEMS AND METHODS FOR TRANSIENT CONTROL OF A FREE-PISTON ENGINE

(71) Applicant: Regents of the University of Minnesota, Minneapolis, MN (US)

(72) Inventors: Zongxuan Sun, Plymouth, MN (US); Ke Li, Minneapolis, MN (US)

(73) Assignee: Regents of the University of Minnesota, Minneapolis, MN (US)

( * ) Notice: Subject to any disclaimer, the term of this patent is extended or adjusted under 35 U.S.C. 154(b) by 0 days.

(21) Appl. No.: 14/784,243

(22) PCT Filed: Apr. 15, 2014

(86) PCT No.: PCT/US2014/034234

§ 371 (c)(1),
(2) Date: Oct. 13, 2015

(87) PCT Pub. No.: WO2014/172382

PCT Pub. Date: Oct. 23, 2014

(65) Prior Publication Data

US 2016/0032820 A1 Feb. 4, 2016

Related U.S. Application Data

(60) Provisional application No. 61/812,462, filed on Apr. 16, 2013.

(51) Int. Cl.
*F02B 71/00* (2006.01)
*F02D 41/00* (2006.01)
(Continued)

(52) U.S. Cl.
CPC ..... *F02B 71/00* (2013.01); *F02D 35/023* (2013.01); *F02D 41/009* (2013.01); *F02D 45/00* (2013.01);
(Continued)

(58) Field of Classification Search
CPC ..... F02B 71/00; F02B 71/04; F02B 71/045; F02B 11/00; F02D 35/023; F02D 2200/1012; F02D 41/009; F02D 45/00
(Continued)

(56) References Cited

U.S. PATENT DOCUMENTS 2,966,148 A * 12/1960 Jarret ..... F02B 53/00 123/46 E
3,643,638 A * 2/1972 Braun ..... F02B 71/00 123/179.5
(Continued)

FOREIGN PATENT DOCUMENTS

CN 101260840 B * 10/2010
JP 2008223628 A * 9/2008
(Continued)

OTHER PUBLICATIONS

Mikalsen, R. and Roskilly, A.P., "A review of free-piston engine history and applications," Applied Thermal Engineering, vol. 27, Issues 14-15, pp. 2339-2352, Oct. 2007.*
(Continued)

*Primary Examiner* — John Zaleskas
(74) *Attorney, Agent, or Firm* — Schwegman Lundberg & Woessner, P.A.

(57) ABSTRACT

A free-piston ("FP") engine is a type of internal combustion engine with no crankshaft, so that its piston trajectory is no longer constrained by the mechanical linkage. FP engines have a high potential in terms of energy saving given their simple structure, high modularity and high efficiency, among other attributes. One of the technical barriers that affect FP engine technology is a lack of precise piston trajectory control. For example, the presence of a transient period after a single combustion event can prevent the engine from continuous firing. The present subject matter provides a control scheme that can utilize a reference and control signal
(Continued)

shifting technique to modify the tracking error and the control signal to reduce the transient period.

31 Claims, 11 Drawing Sheets

(51) Int. Cl.
*F02D 45/00* (2006.01)
*F02D 35/02* (2006.01)
*F02D 41/14* (2006.01)
*F01B 11/00* (2006.01)

(52) U.S. Cl.
CPC ..... *F01B 11/00* (2013.01); *F02D 41/1448* (2013.01); *F02D 2200/0406* (2013.01); *F02D 2200/1012* (2013.01)

(58) Field of Classification Search
USPC ..... 123/46 A, 46 E, 46 H, 46 R, 46 SE; 60/595, 596; 701/101, 102
See application file for complete search history.

(56) References Cited

U.S. PATENT DOCUMENTS 3,673,999 A * 7/1972 Lacy ..... F02B 71/00 123/149 H
5,287,827 A * 2/1994 Almendinger ..... F02B 71/00 123/46 R
6,170,442 B1 * 1/2001 Beale ..... F02B 71/00 123/46 B
6,206,656 B1 * 3/2001 Bailey ..... F02B 71/02 123/46 B
6,286,482 B1 9/2001 Flynn et al.
6,314,924 B1 * 11/2001 Berlinger ..... F02B 71/045 123/46 R
6,971,339 B2 * 12/2005 Janssen ..... F02B 71/00 123/46 R
6,983,724 B2 1/2006 Calrson
7,066,116 B2 * 6/2006 Jacobsen ..... F02B 75/28 123/46 R
7,075,292 B2 * 7/2006 Berchowitz ..... F02G 1/06 324/207.2
7,116,004 B2 * 10/2006 Kemper ..... H02P 9/04 290/40 C
7,258,085 B2 * 8/2007 Niiyama ..... F02B 63/04 123/46 E
7,261,070 B2 * 8/2007 Jones ..... F02B 71/04 123/46 SC
7,721,686 B2 * 5/2010 Lindgarde ..... F02B 71/00 123/46 E
7,845,317 B2 * 12/2010 Max ..... F02B 1/12 123/41.66
9,657,675 B1 * 5/2017 Roelle ..... F02D 41/1497
2002/0023598 A1 * 2/2002 Valentin ..... B60K 6/12 123/46 R
2005/0028520 A1 2/2005 Chertok
2005/0082994 A1 4/2005 Qiu et al.
2005/0257757 A1 * 11/2005 Kemper ..... H02P 9/04 123/46 E
2008/0122408 A1 5/2008 Keiter et al.
2009/0031991 A1 * 2/2009 Lindgarde ..... F02B 71/00 123/46 R
2009/0101005 A1 * 4/2009 Pohl ..... F01B 11/007 92/85 B
2009/0271088 A1 * 10/2009 Langham ..... F01B 11/004 701/102
2011/0083643 A1 * 4/2011 Sturman ..... F01B 11/006 123/46 R
2011/0174271 A1 * 7/2011 Wood ..... F02B 63/04 123/46 E
2012/0024264 A1 * 2/2012 Mikalsen ..... F02G 1/02 123/46 R
2012/0318239 A1 * 12/2012 Sturman ..... F02B 71/045 123/46 A
2013/0025570 A1 1/2013 Sturman
2013/0298874 A1 11/2013 Sun et al.

FOREIGN PATENT DOCUMENTS

JP 2009008069 A * 1/2009
JP 2012202386 A * 10/2012
JP 2012202387 A * 10/2012
KR 101154516 B1 * 6/2012
WO WO-2014172382 A1 10/2014

OTHER PUBLICATIONS

Mikalsen, R. and Roskilly, A.P., "The control of a free-piston engine generator. Part 1: Fundamental analyses," Applied Energy, vol. 87, Issue 4, pp. 1273-1280, Apr. 2010.*
Mikalsen, R. and Roskilly, A.P., "The control of a free-piston engine generator. Part 2: Engine dynamics and piston motion control," Applied Energy, vol. 87, Issue 4, pp. 1281-1287, Apr. 2010.*
Mikalsen, R., Jones, E. and Roskilly, A.P., "Predictive piston motion control in a free-piston internal combustion engine," Applied Energy, vol. 87, Issue 5, pp. 1722-1728, May 2010.*
Li, K. and Sun., Z., "Modeling and Control of a Hydraulic Free Piston Engine with HCCI Combustion," Proceedings of the 52nd National Conference on Fluid Power, pp. 567-576, 2011.*
Li, K. and Sun., Z., "Stability Analysis of a Hydraulic Free Piston Engine with HCCI Combustion," DSCC, pp. 1-8, 2011.*
Li, K., Sadighi, A. and Sun, Z., "Motion Control of a Hydraulic Free-piston Engine," American Control Conference, pp. 2878-2883, 2012.*
Johansen, A., Egeland, O., Johannessen, E. and Kvamsdal, R., "Free-Piston Diesel Engine Timing and Control—Toward Electronic Cam- and Crankshaft," IEEE Transactions on Control Systems Technology, vol. 10, No. 2, pp. 177-190, Mar. 2002.*
"International Application Serial No. PCT/US2014/034234, International Search Report dated Sep. 12, 2014", 3 pgs.
"International Application Serial No. PCT/US2014/034234, Written Opinion dated Sep. 12, 2014", 4 pgs.
Sun, Zongxuan, et al., "Methods and Systems for Free Piston Engine Control", U.S. Appl. No. 13/855,363, filed Apr. 2, 2013, 31 pgs.
"International Application Serial No. PCT/US2014/034234, International Preliminary Report on Patentability dated Oct. 29, 2015", 6 pgs.
Li, KE, et al., "Transient Control of a Hydraulic Free Piston Engine", *Proceedings of the ASME 2013 Dynamic Systems and Control Conference* (DSCC2013), vol.1, (2013), V001T12A006-1-V001T12A006-6.
"U.S. Appl. No. 13/855,363, Advisory Action dated Jul. 30, 2015", 3 pgs.
"U.S. Appl. No. 13/855,363, Advisory Action dated Sep. 11, 2015", 3 pgs.
"U.S. Appl. No. 13/855,363, Amendment After Final filed Jan. 11, 2017 in response to Final Office Action dated Aug. 11, 2016", 9 pgs.
"U.S. Appl. No. 13/855,363, Amendment After Final filed Jun. 19, 2018 responsive to the Final Office Action dated Apr. 19, 2018", 6 pgs.
"U.S. Appl. No. 13/855,363, Amendment filed Jan. 14, 2015 in response to Non-Final Office Action dated Aug. 15, 2014", 9 pgs.
"U.S. Appl. No. 13/855,363, Amendment filed Jul. 14, 2016 in response to Non-Final Office Action dated Apr. 14, 2016", 13 pgs.
"U.S. Appl. No. 13/855,363, Final Office Action dated Apr. 19, 2018", 14 pgs.
"U.S. Appl. No. 13/855,363, Final Office Action dated May 7, 2015", 18 pgs.
"U.S. Appl. No. 13/855,363, Final Office Action dated Aug. 11, 2016", 22 pgs.
"U.S. Appl. No. 13/855,363, Interview Summary dated Aug. 26, 2015", 3 pgs.
"U.S. Appl. No. 13/855,363, Interview Summary dated Sep. 2, 2015", 3 pgs.

(56) References Cited

OTHER PUBLICATIONS

"U.S. Appl. No. 13/855,363, Non-Final Office Action dated Apr. 14, 2016", 21 pgs.
"U.S. Appl. No. 13/855,363, Non-Final Office Action dated Aug. 15, 2014", 16 pgs.
"U.S. Appl. No. 13/855,363, Non-Final Office Action dated Aug. 22, 2017", 17 pgs.
"U.S. Appl. No. 13/855,363, Request for Reconsideration filed Jul. 7, 2015 in response to Final Office Action dated May 7, 2015", 11 pgs.
"U.S. Appl. No. 13/855,363, Response filed Dec. 20, 2017 to Non-Final Office Action dated Aug. 22, 2017", 13 pgs.
"U.S. Appl. No. 13/855,363, Second Response After Final filed Sep. 2, 2015 in response to Final Office Action dated May 7, 2015", 13 pgs.
Abenavoli, Romano I., et al., "First Experimental Analysis of an Internal Combustion Engine With Variable Stroke and Compression Ratio", *Proceedings of the 25th Intersociety Energy Conversion Engineering Conference*, (1990), 198-203.
Chiang, Chia-Jui, et al., "Dynamic Modeling of SI/HCCCI Free-Piston Engine Generators", *2011 6th IEEE Conference on Industrial Electronics and Applications*, (2011), 1615-1620.
Goldsborough, S. Scott, et al., "A Numerical Study of a Free Piston IC Engine Operating on Homogeneous Charge Compression Ignition Combustion", *SAE Technical Paper 1999-01-0619, SAE Trans*., vol. 108, (1999), 14 pgs.
Hibi, A., et al., "Fundamental test results of a hydraulic free piston internal combustion engine", *Proceedings of the Institution of Mechanical Engineers, Part D: Journal of Automobile Engineering*, vol. 218, Issue 10, (2004), 1149-1157.
Kadota, M., "Advanced Control System of Variable Compression Ratio (VCR) Engine with Dual Piston Mechanism", *SAE Technical Paper 2009-01-1063, SAE Int. J. Engines* 2(1), (2009), 1009-1018.
Sadighi, Ali, et al., "A Comparative Study of Permanent Magnet Linear Alternator and Hydraulic Free-Piston Engines", *ASME 2011 Dynamic Systems and Control Conference and Bath/ASME Symposium on Fluid Power and Motion Control*, vol. 1, Arlington, Virginia, USA, Oct. 31-Nov. 2, 2011, (2011), 137-144.
Shoukry, Ehab, et al., "Numerical Simulation for Parametric Studty of a Two-Stroke Direxi Injection Linear Engine", *SAE Technical Paper 2002-01-1739, SAE Trans*. vol. 111, (2002), 12 pgs.
Somhorst, Joop H. E., et al., "The Combustion Process in a DI Diesel Hydraulic Free Piston Engine", *SAE Technical Paper 960032, SAE Trans*, vol. 105, (1996), 37-50.
Sugiyama, T., "Technology for Improving Engine Performance using Variable Mechanism", *SAE Technical Paper*, 2007-01-1290, (2007), 10 pgs.
Sun, Zongxuan, et al., "Transient Control of Electro-Hydraulic Fully Flexible Engine Valve Actuation System", *IEEE Transactions on Control Systems Technology*, vol. 18, No. 3, (May 2010), 613-621.
Tikkanen, S., et al., "Control of dual hydraulic free piston engine", *International Journal of Vehicle Autonomous Systems*, 4(1), (2006), 3-23.
Tomizuka, M., et al., "Analysis and synthesis of discrete-time respective controllers", ASME Trans., *J. Dyn. Sys., Meas. Control*, vol. 111, (Sep. 1989), 353-358.
Tsao, T. C., et al., "Robust Adaptive and Repetitive Digital Tracking Control and Application to a Hydraulic Servo for Noncirculaar Machinining", *ASME Trans., J. Dyn. Syst., Meas. Control*, vol. 116, (Mar. 1994), 24-32.

* cited by examiner

SYSTEMS AND METHODS FOR TRANSIENT CONTROL OF A FREE-PISTON ENGINE

CLAIM OF PRIORITY

This patent application is a U.S. National Stage Under 35 U.S.C. 371 of International Application No. PCT/US2014/034234, filed Apr. 15, 2014, which published as WO 2014/172382A1on Oct. 23, 2014, which claims the benefit of priority to U.S. Provisional Patent Application Ser. No. 61/812,462, filed on Apr. 16, 2013, both of which are hereby incorporated by reference herein in their entirety.

STATEMENT REGARDING FEDERALLY SPONSORED RESEARCH OR DEVELOPMENT

This invention was made with government support under Grant No. EEC-0540834, awarded by the National Science Foundation. The government has certain rights in this invention.

BACKGROUND

A free-piston ("FP") engine is a "crank-less" internal combustion engine in which the piston moves within an elongated chamber by a combustion within the combustion portion of the chamber. In conventional crank internal combustion ("IC") engines, the piston is connected to a flywheel by a linear crankshaft such that the linear movement of the piston from the combustion event actuates the crankshaft to rotate the flywheel for operating a hydraulic pump or other mechanical system. In conventional IC engines, the continued rotation of the flywheel is translated to the piston via the crankshaft to cycle the piston back to the original position. In contrast, the expansion of the piston of the FP engine operates a hydraulic pump, linear alternator or other load device to store or use the kinetic energy. In certain FP engines, the exhaust gases from the combustion event are also fed through a gas turbine engine. The piston of the FP engine is compressed by using a portion of the stored energy to reverse the load device or with a rebound device, such as an opposing free-piston engine.

The absence of a crankshaft and flywheel assembly in an FP engine reduces the number of moving parts thereby reducing frictional losses in the load device from the moving parts providing improved efficiency of the FP engine. Without the crankshaft and flywheel, the cycling of the FP engine is mainly dependent on the dynamic coupling of the in-cylinder gas dynamics, the load applied by the load device and the piston trajectory. However, unlike conventional IC engines where the crankshaft can be used to correct irregular movement, FP engines cannot directly mechanically control the piston movement. As a result, the operation of FP engines often varies cycle-to-cycle, especially during transient operation such as combustion events, which can make engine control difficult and cause the engine to misfire. In particular, the FP engine is subject to transient behavior when switching between operational modes such as from motoring mode to a firing mode and vice versa resulting in large tracking errors and other ill effects.

The transient nature of FP engines makes achieving robust and precise engine operation control difficult. The current control methodologies for FP engines are primarily calibration methodologies that have had limited success and are primarily limited to single piston FP engines. In a calibration-based methodology, the system is set for normal operating mode based on desired operation conditions and at an effective efficiency. However, transient events can create irregular piston trajectory that cannot be efficiently regulated by current calibration-based methodology.

OVERVIEW

This document pertains generally, but not by way of limitation, to free piston engine designs and architectures, and in particular, to control systems and methodologies for a free piston engine for active and dynamic control of piston trajectory of a FP engine through transient events, such as combustion events. The present inventors have recognized, among other things, that a problem to be solved can include irregular piston trajectory for a transient period following a transient event. The irregular piston trajectory can cause substantial tracking errors between the actual piston trajectory and a reference trajectory, which can result in the control methodology operating substantially out-of-phase with the actual piston trajectory. In an example, the present subject matter can provide a solution to this problem, such as by providing a control algorithm that includes detecting a combustion event and applying a reference shift corresponding to the transient period to the reference trajectory and the control signal to realign the control signal with the actual piston trajectory following the combustion event. The present inventors have recognized that the actual piston trajectory returns to a regular periodic trajectory following the irregular trajectory following the combustion event. Accordingly, the shifting of the reference shifting can include determining the timing of the combustion or other event causing the transient period and shifting the reference trajectory to realign the reference trajectory of the control signal with the actual piston trajectory following the transient period. Detection of transient events and reference shifting of the reference trajectory until after the transient period avoids large tracking errors and operating of the FP engine when the control signal and the actual piston trajectory are out-of-phase. The shifting of the reference trajectory and control signal provides a more robust control of FP engine during transient events and allows implantation of multi-occurrence combustion events or continuous firing operation of the FP engine with reduced risk of misfire or other negative engine behavior.

In an example, a method for operating a FP engine can include reciprocating a piston in an engine cylinder to displace a force transducer, the piston traveling along an actual piston trajectory. The method can further include monitoring engine operation by comparing actual piston trajectory of an oscillating piston to a reference trajectory and locating a first local extremum for the actual piston trajectory. The first extremum can correspond to a first actual reversal point of the reciprocating piston. The method can further include recording a first time instant corresponding to the first local extremum and comparing the first time instant to a first reference time index to detect a first combustion event. The reference time index can correspond to a first reference reversal point corresponding to the first actual reversal point. The method can include applying a first reference shift to the reference trajectory upon detecting of the first combustion event. The reference shift can correspond to the difference between the first time instant and the first reference time index. The method can include operating the force transducer to influence the actual piston trajectory to approximate the shifted reference trajectory.

In an example, a free-piston engine can include a controller configured to compare an actual piston trajectory of an oscillating piston to a reference trajectory. The controller can also be configured to locate a first local extremum for the actual piston trajectory, the extremum corresponding to a first actual reversal point for the oscillating piston and record a first time instant corresponding to the local extremum. The controller can also be configured to detect a first combustion event by comparing the first time instant to a first reference time index. The reference time index can correspond to a first reference reversal point corresponding to the first actual reversal point. The controller can also be configured to apply a first reference shift to the reference trajectory upon detecting the first combustion event. The first reference shift can correspond to the difference between the first time instant and the reference time index. The free-piston engine can also include an engine cylinder for slidably receiving the piston and a force transducer coupled to the piston. The controller can be coupled to the force transducer and configured to control the force transducer to influence the piston oscillation such that the actual piston trajectory approximates the reference trajectory.

This overview is intended to provide an overview of subject matter of the present patent application. It is not intended to provide an exclusive or exhaustive explanation of the present subject matter. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

The present subject matter is directed to an FP engine and related control methodologies for operating the FP engine. In an example, the present subject matter is related to a "virtual" crankshaft control methodology that compares actual piston trajectory with a reference trajectory to coordinate combustion events and operation of a load device, such as a force transducer, to adjust piston trajectory in a similar manner to a mechanical crankshaft of a conventional IC engine. The "virtual" crankshaft control is described in U.S. patent application Ser. No. 13/855,363, filed Apr. 2, 2013, entitled "Methods and Systems for Free-piston Engine Control," which claims the benefit of U.S. Provisional Patent Application No. 61/619,169, filed Apr. 2, 2012, entitled "Methods and Systems for Free-piston Engine Control", each of which is incorporated herein by reference in their entirety. Specifically, the present subject matter relates to a "virtual" crankshaft control methodology configured to detect a transient event, such as a combustion event, and applies a corresponding reference shift to the reference trajectory for to minimize tracking errors between the actual piston trajectory and the reference trajectory and prevent out-of-phase control of the piston.

Figure 1:
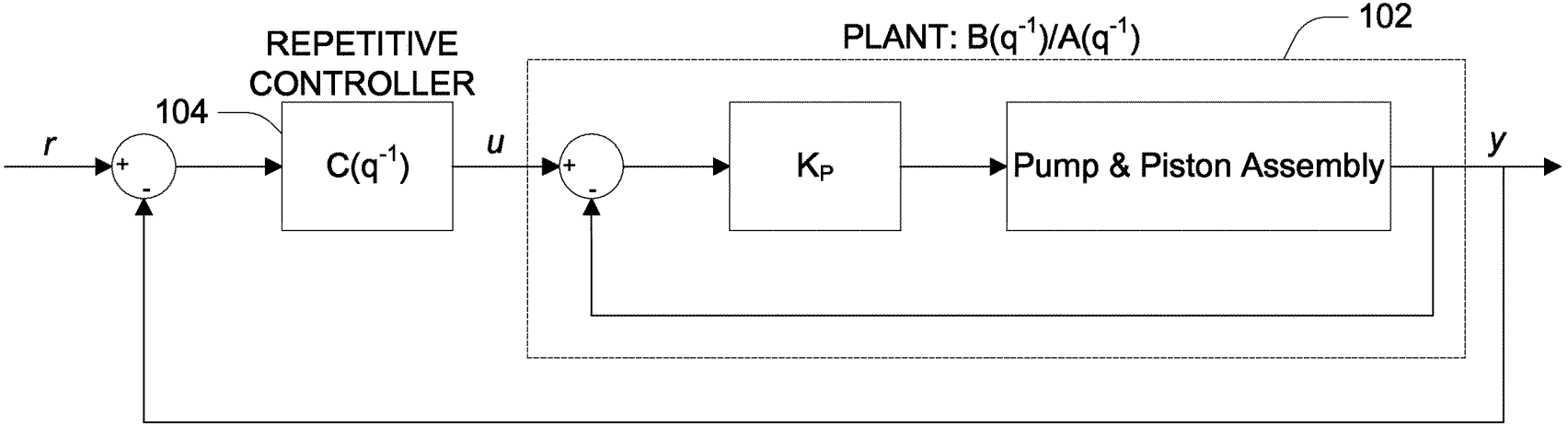
FIG. 1 is a schematic view of a control system, according to an example.

As the piston trajectory in an FP engine is periodic, a control method that can be adopted is repetitive control as depicted in FIG. 1. The control method includes a stabilized system 102 and a repetitive controller 104. The controller 104 operates as a "virtual" crankshaft that guides the piston trajectory via control of the load device, such as a linear alternator or a hydraulic accumulator with a hydraulic servo valve regulating the high pressure fluid in the accumulator. The control algorithm and the reference trajectory of the virtual crankshaft can be altered digitally to achieve a wide range of piston trajectory profile within a short time period, which is not achievable through mechanical crankshaft. With a mechanical crankshaft, the piston trajectory is fixed and is independent from engine speed and load limiting means for optimizing the engine efficiency. However, with the virtual crankshaft, the piston trajectory can be varied in real time by altering the reference trajectory. Optimal trajectories can be determined for the engine under various frequencies and load conditions, such that the engine would always run at its maximum efficiency.

Figure 2:
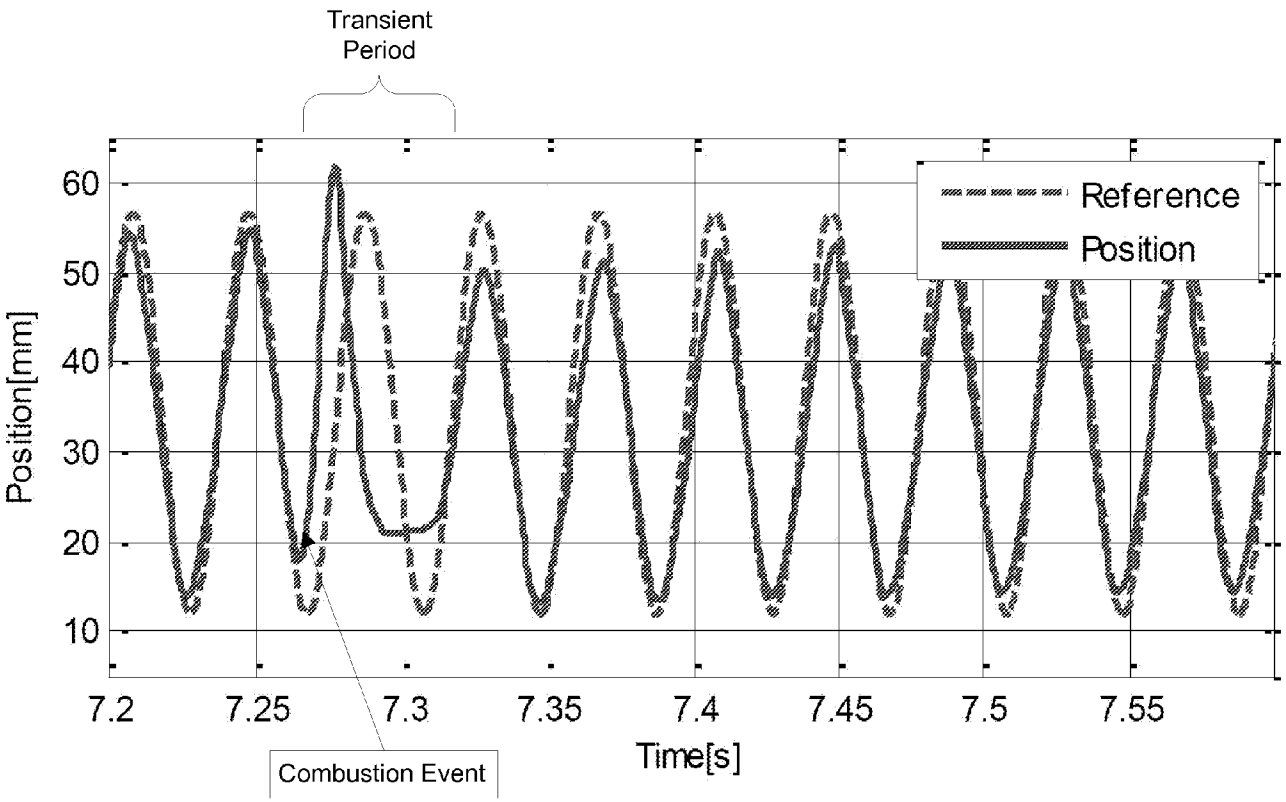
FIG. 2 is a chart illustrating engine piston position over time with a single combustion event, according to an example.

As depicted in FIG. 2, a transient event, such as combustion event, can disrupt the oscillating movement of the piston for a transient period. The repetitive controller 104 of the piston is based on an estimated linear model of the piston trajectory:

$$y(k) = \frac{R(q^{-1})}{A(q^{-1})}u(k)$$

where k indicates the current time, u(k) is the control signal and y(k) is the measured piston position. The control signal u(k) can be expressed as:

$$u(k)=Q(q^{-1})[u(k-N)+R(q^{-1})\cdot e(k-N)]$$

where Q is a low pass filter, $q^{-1}$ is the one sample delay operator, N is the delay steps that equal to the reference period, and e(k−N) is the tracking error. As such, the current control signal u(k) depends on the control signal u(k−N) and the tracking error e(k−N) from the prior piston cycle. As the transient event disrupts the periodic movement of the piston, the actual piston trajectory of subsequent piston cycles following the transient event will differ substantially from the actual piston trajectory, resulting in large tracking errors and cause the control signal to be substantially out-of-phase with the actual piston trajectory. It is recognized that while the piston trajectory and control signal are out-of-phase, the piston trajectory returns to a trajectory having a similar slope to cycles prior to the combustion cycle. Accordingly, the phase shift of the actual piston trajectory resulting from the combustion event can be compensated for by applying a corresponding reference shift to the reference trajectory, tracking error and the control signal.

Figure 3:
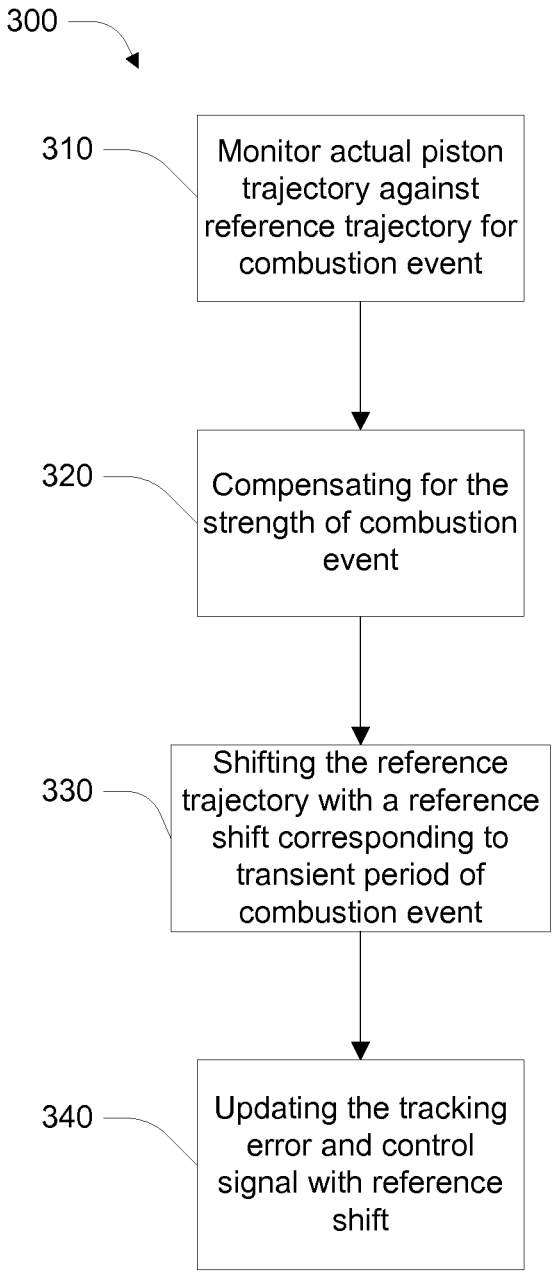
FIG. 3 is a flow chart illustrating a method of applying a reference shift to compensate for a combustion event, according to an example.
Figure 4:
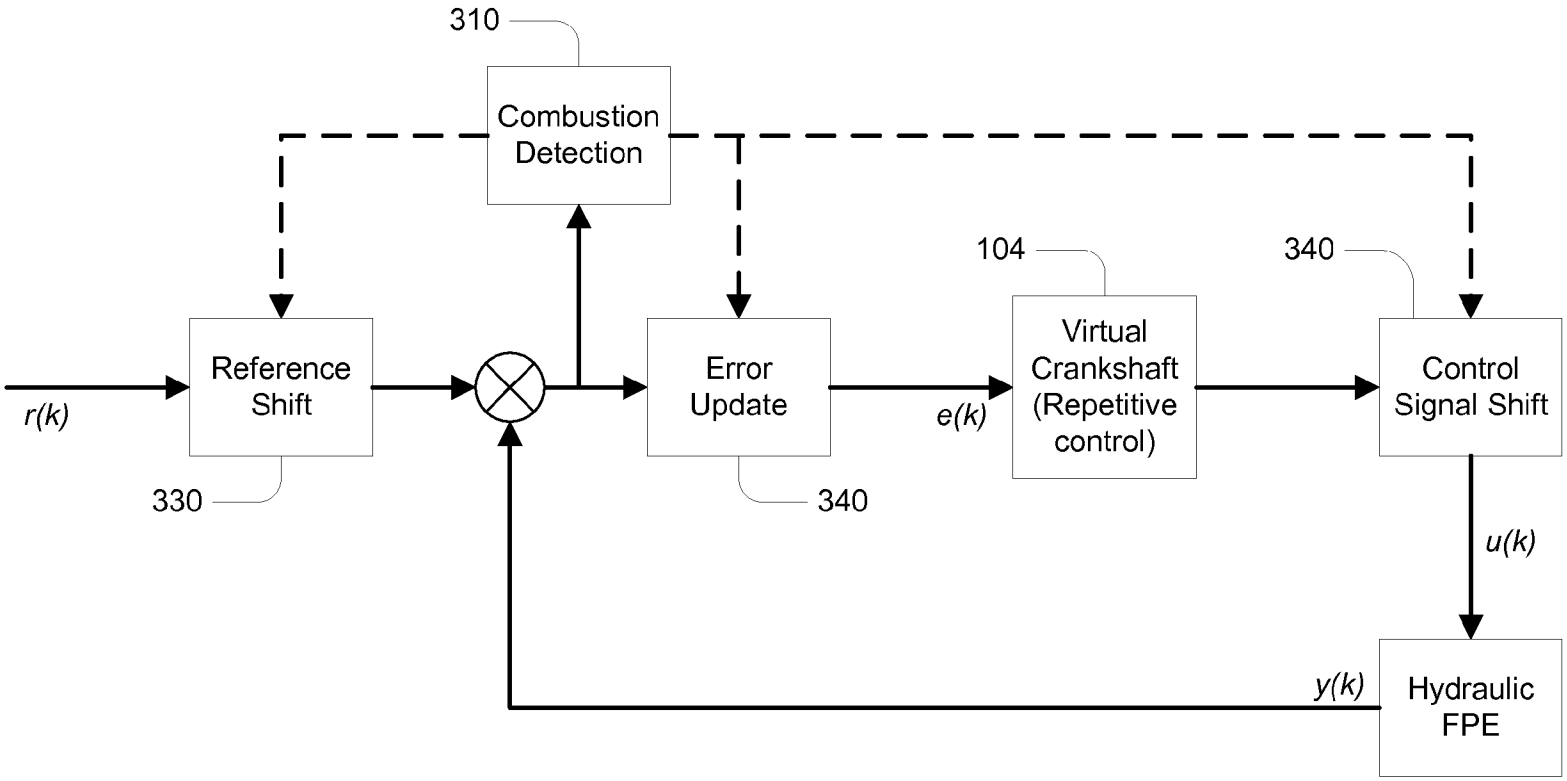
FIG. 4 is a schematic view of a FP engine piston trajectory controller, according to an example.

As depicted in FIG. 3, a method 300 for correcting the phase shift following a combustion event includes monitoring 310, compensating 320, shifting 330 and updating 340. The method can be incorporated into the repetitive controller 104 as depicted in FIG. 4.

Method 300 at monitoring 310 includes monitoring piston trajectory for a combustion event. In an example, monitoring 310 includes monitoring the piston trajectory for a local extremum minimum, such as a local minimum or maximum, at a time instant k. The local extremum corresponds to a reversal point for the oscillating piston such as an actual top dead center (TDC) position or a bottom dead center (BDC) position. The piston position at time instant k is compared to the reference piston position at a time index j on the reference trajectory, the time index j corresponding to reference piston position at a corresponding TDC or BDC position. In an example, if the difference between the time instant k and the time index j exceeds a predetermined threshold, a combustion event or other transient event has likely occurred as the piston has reached TDC or BDC too quickly or slowly. In certain examples, if the difference between the piston position at time instant k and the reference piston position at time index j is greater than a predetermined amount than the piston trajectory has substantially deviated from the prior cycle indicating that combustion event has likely occurred. Similarly, a combustion event will cause the piston to travel faster than the average velocity of the piston or accelerate faster than the piston in a non-combustion cycle. Accordingly, if the average velocity or acceleration of the piston is greater than the historical average velocity of the piston then a combustion event has likely occurred. Accordingly, in certain examples, monitoring 310 can include monitoring for both the differences in piston position and average velocity and declaring a combustion event only when the timing of the reversal points for the piston, piston position at reversal points, average velocity measurements, piston acceleration or at least two indicia signal a combustion event. In certain examples, other indicia unrelated to piston motion can be used to detect or confirm a combustion event such as temperature changes, pressure changes, auditory signals, vibrations and other indicia of combustion events or changes in the piston trajectory.

Figure 5:
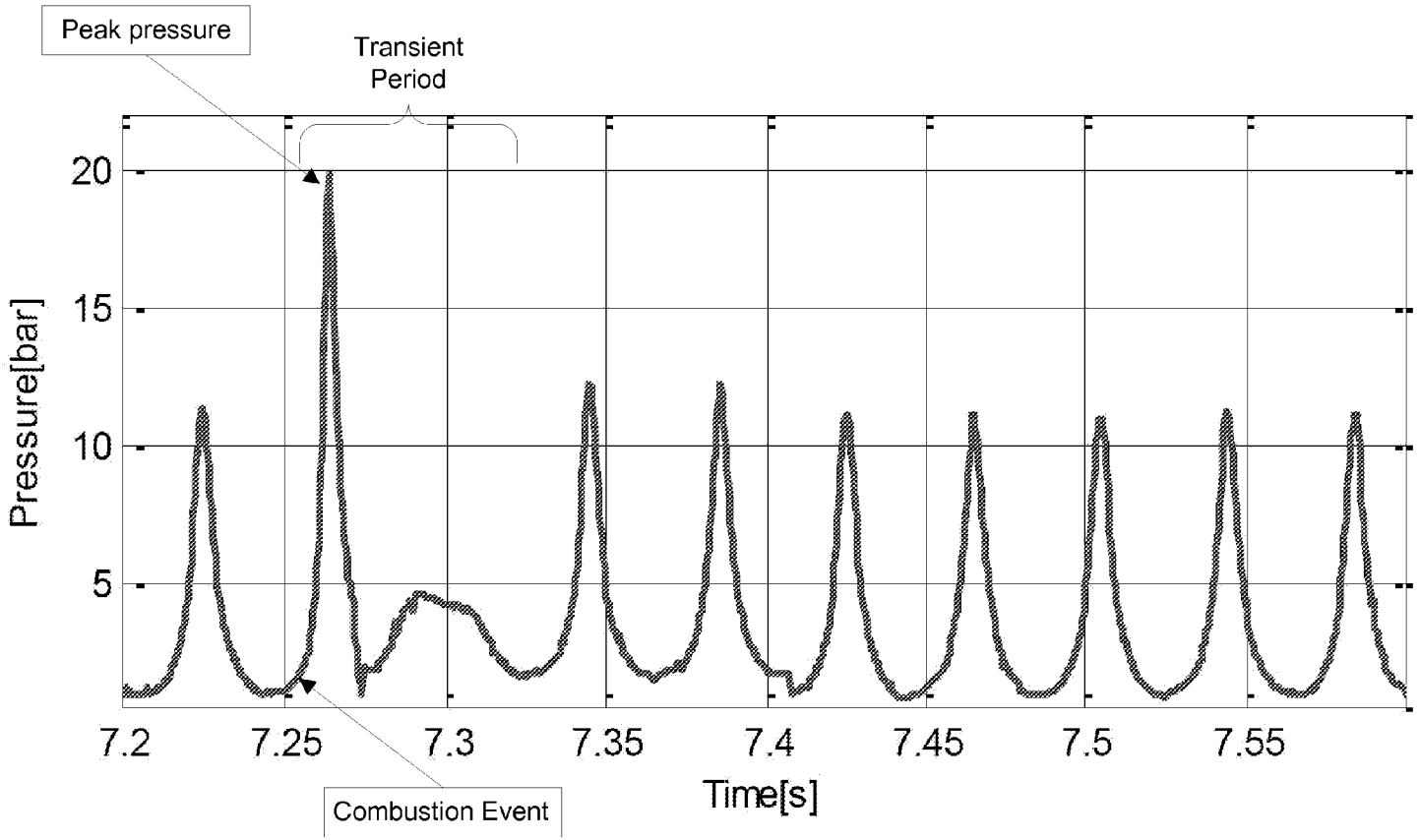
FIG. 5 is a chart illustrating engine pressure over time with a single combustion event, according to an example.

In an example, at compensating 320, method 300 can also include evaluating combustion strength to more accurately tailor the reference shift to the particular combustion event. As combustion events and the effects therefrom are often non-repetitive, a reference shift calculated for a prior combustion event may not correct the reference trajectory and control signal for the present combustion event. In an example, the combustion strength can be correlated with the peak pressure and other factors representative of the combustion strength as illustrated in FIG. 5. In this configuration, the combustion strength of a present combustion event is compared to the combustion strength of a prior combustion event to generate a strength compensation term. The strength compensation term can be used to modify the reference shift. In an example, compensating 320 can also include monitoring acceleration of the piston following the time instant k. The acceleration of the piston can also be indicative of the strength and other characteristics of the particular combustion event. In an example, a correction based on the measured acceleration can be applied to the reference trajectory in addition to the reference shift to adjust the amplitude or frequency of the reference trajectory. Each combustion event can influence the characteristics of the actual piston trajectory such as the amplitude or frequency of the reference trajectory. While the changes can be relatively minor as compared to the shifting actual piston trajectory, the correction can further reduce the tracking errors between the actual piston trajectory and the reference trajectory.

At shifting 330, method 300 can include calculating the reference shift if a combustion event is detected. The reference shift is the difference between time instant k and time index j. The reference shift is applied to the reference trajectory to generally align the reference trajectory to the actual piston trajectory following the combustion event.

Figure 6:
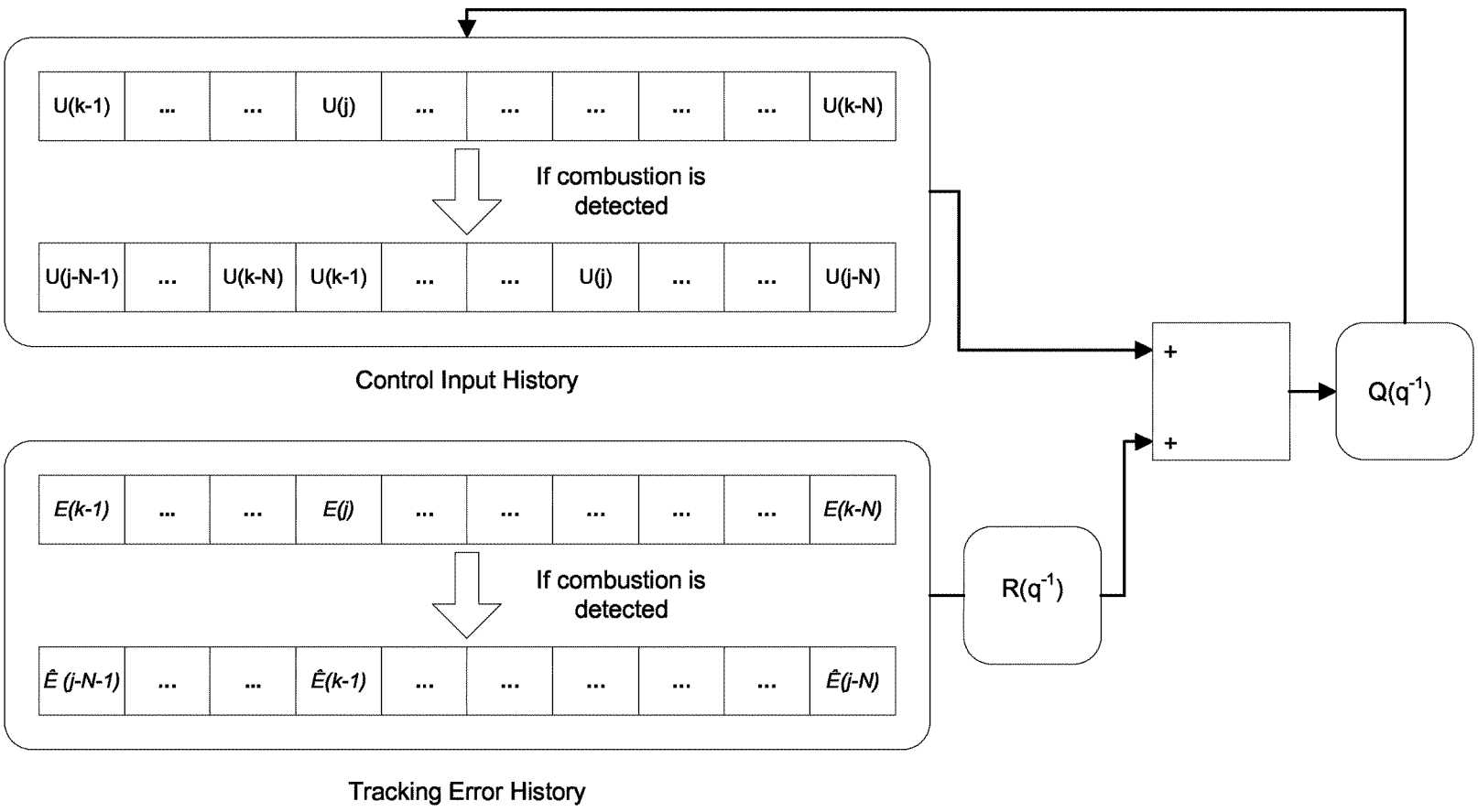
FIG. 6 is a schematic illustrating updating and shifting of a control signal, according to an example.

In an example, the method 300 can include a tracking error and control signal update 340. The error update corresponds to the time elapsed between the actual combustion event and when the combustion event is actually detected. As the control signal from j+N to k+N is dependent on the error signal from j to k, large errors from j to k are replaced by the new errors to avoid undesired control signal. The new errors are the difference between the piston position and the shifted reference trajectory from j+N to k+N. Since the reference has been shifted forward by a time period of k−j, the control signal needs to be shifted accordingly as well. In an example, the tracking error e(k) and the control signal u(k) are shifted by a corresponding reference shift as with the reference trajectory. Accordingly, as depicted in FIG. 6, the control signal u(k) is calculated by using u(j−N) rather than u(k−N) at time instant k. Similarly, the tracking error e(k) is determined by using e(j−N) rather than e(k−N) at time instant k.

Figure 7:
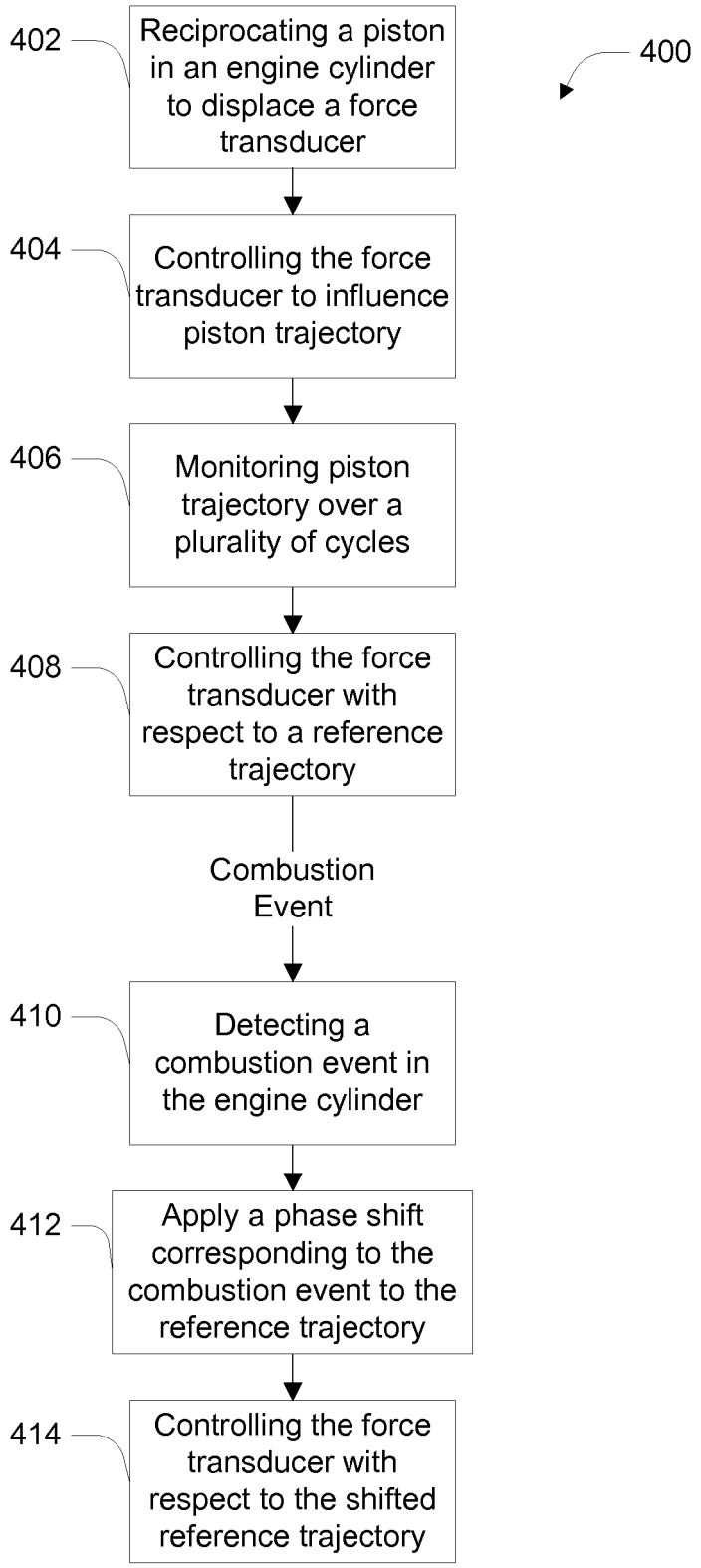
FIG. 7 is a flow chart illustrating a method of controlling a FP engine, according to an example.

A method 400 of controlling an FP engine, according to an example, is depicted in FIG. 7. At 402, the method can include reciprocating a piston in an engine cylinder to displace a force transducer. In an example, an energy storage device coupled to the force transducer to store force transducer energy and power the force transducer. In certain examples, the force transducer comprises a linear alternator and the energy storage device comprises a battery. In other examples, the force transducer comprises a hydraulic pump, and the piston is connected with a plunger of a hydraulic pump that is coupled with the energy storage device. At 404, the method can include controlling the force transducer to influence the actual piston trajectory, wherein the controller is controlling stored energy from the force transducer in the energy storage device, and to control powering the force transducer with energy from the energy storage device. The controller can include a processor and be configured to execute instructions stored on a machine-readable medium including instructions that, when performed by a machine, cause the machine to perform any one or more of the functions of method 400. At 406, the method can include storing the piston trajectory over multiple piston cycles. The method can include predetermining the piston location over time to determine a reference trajectory. At 408, the method can include controlling the force transducer in association with the reference trajectory such that the actual piston trajectory aligns with the reference trajectory. In a method, this can include a one-to-one correspondence between cycles of the reference trajectory and cycles of the engine. At 410, the method can include detecting combustion in the engine cylinder during a combustion cycle and for a subsequent cycle to the combustion cycle. At 412, the method can include applying a reference shift to the reference trajectory with respect to the subsequent cycle by N cycles as illustrated in FIG. 6. N can be an integer. This can include shifting from a first cycle of the reference trajectory to another cycle of the reference trajectory. At 414, the force transducer is controlled according to the shifted reference trajectory to influence the actual piston trajectory of the piston to minimize tracking errors between the shifted reference trajectory and the actual piston trajectory. The force transducer can be configured to adjust movement of the piston to align the actual trajectory of the piston with the reference trajectory.

A method can include, or can optionally be combined with any portion or combination of any portions of any one or more of the previous methods, comprising detecting combustion in the cylinder by monitoring at least one of intake port pressure, exhaust port pressure, and location of the piston. A method can include, or can optionally be combined with any portion or combination of any portions of any one or more of the previous methods, wherein detecting combustion includes determining whether the piston has arrived at a specific location before a time in the reference trajectory at which the piston is predetermined to reach the location. A method can include, or can optionally be combined with any portion or combination of any portions of any one or more of the previous methods, wherein detecting combustion includes predetermining cylinder pressure over time over multiple cycles of the engine, storing the predetermined pressure over multiple cycles in the reference trajectory, and determining whether the pressure at a specific time in the reference trajectory is higher than the predetermined pressure in the reference trajectory.

Figure 8:
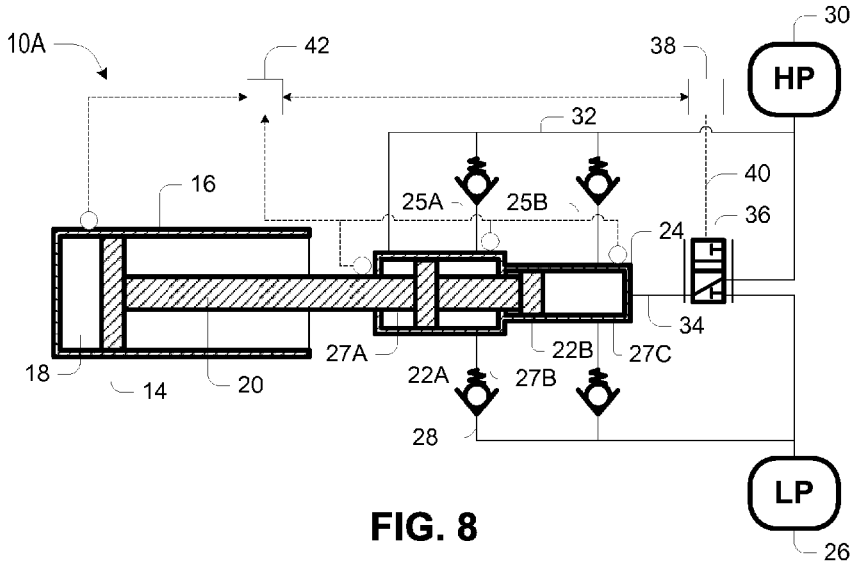
FIG. 8 is a schematic illustration of a single piston free piston engine according to an example.

FIG. 8 depicts a single piston configuration for a hydraulic FP engine 10A for use with a control methodology, according to an example of the present subject matter. Engine 10A includes a piston 14 and a cylinder 16. The piston 14 and the cylinder 16 cooperate to define a combustion chamber 18. The piston 14 is connected to a rod 20 to a first plunger 22A and a second plunger 22B positioned within a hydraulic cylinder 24 such that the oscillation of the piston 14 oscillates the first plunger 22A and the second plunger 22B.

The hydraulic cylinder 24 includes a large diameter portion 25A and a small diameter portion 25B. The first plunger 22A is sized to correspond to the inner diameter of the hydraulic cylinder 24 at the large diameter portion 25A. The second plunger 22B is sized to correspond to the inner diameter of the hydraulic cylinder 24 at the small diameter portion 25B. The first plunger 22A and the second plunger 22B are spaced along the rod 20 within the hydraulic cylinder 24 to define three chambers within the hydraulic cylinder 24: the left most first chamber 27A, the center second chamber 27B and the right most third chamber 27C. The first chamber 27A has a constant diameter corresponding to the inner diameter of the large diameter portion 25A throughout the oscillation of the piston 14. The third chamber 27C has a constant diameter corresponding to the inner diameter of the small diameter portion 25B throughout the oscillation of the piston 14. The second chamber 27B has a constant diameter corresponding to the inner diameter of the large diameter portion 25A throughout the oscillation of the piston 14, wherein an intermediate wall is positioned between the second chamber 27B and the second plunger 22B.

A low pressure hydraulic fluid accumulator 26 is fluidly connected via a line 28 to the hydraulic cylinder 24 at the second chamber 27B and the third chamber 27C. The flow from the second chamber 27B and third chamber 27C to line 28 are regulated by check valves. A high pressure fluid accumulator 30 is fluidly connected via line 32 to each chamber 27A, 27B, 27C of the hydraulic cylinder 24. The flow from the second chamber 27B and third chamber 27C to line 32 are regulated by check valves. A valve 36 selectively connects the third chamber 27C to the high pressure accumulator 30 and the low pressure accumulator 26 via line 34. The valve 36 is configured to switch the connection to the third chamber 27C between the high pressure accumulator 30 and the low pressure accumulator 26.

During expansion of combustion chamber 18, combustion gas is introduced into the combustion chamber 18 by a valve (not shown in this figure). When the piston 14 is positioned at top dead center (TDC), the gas is ignited by auto-ignition or a spark device (not shown) including, but not limited to, a spark plug. The ignited gases push the piston 14 through the cylinder 16, which correspondingly moves the plungers 22A, 22B within the hydraulic cylinder 24 compressing hydraulic fluid in the third chamber 27C. During expansion of the combustion chamber 18 the valve 36 can be positioned to direct the fluid compressed in the third chamber 27C to the high pressure accumulator 30. The pressure of the compressed fluid can also overcome the check valve coupled to chamber 27C and is directed to the high pressure accumulator via line 32. Accordingly, the kinetic energy of the piston movement is converted into hydraulic energy that is stored in the accumulator 30. Similarly, movement of piston 14 will also cause the effective volume of the second chamber 27B to decrease, thus compressing the fluid within the second chamber 27B until the pressure exceeds the pressure limit of corresponding check valve allowing the excess fluid to enter line 32. The movement of piston 14 will also cause the volume of the first chamber 27A to expand. In an example, the large diameter portion 25A and the small diameter portion 25B are sized such that the volume of fluid expelled from the second chamber 27B approximates the amount of fluid drawn in the first chamber 27A as the first chamber 27A expands.

During combustion chamber compression, valve 36 is positioned such that high pressure hydraulic fluid from the high pressure accumulator 30 is directed into the third chamber 27C causing the third chamber 27C to expand and compressing the first chamber 27A. The compression of the hydraulic fluid in the first chamber 27A forces the excess hydraulic fluid in the first chamber 27A to the high pressure accumulator 30 via line 32. Similarly, movement of the piston 14 to compress the combustion chamber causes the volume of the second chamber 27B to increase. Hydraulic fluid is drawn from the low pressure accumulator 26 into the second chamber 27B to accommodate the increasing volume of the second chamber 27B.

If a misfire occurs during expansion and the piston 14 fails to move or moves slowly toward bottom dead center, valve 36 can be switched to direct fluid from the third chamber 27C to the low pressure accumulator 26 thereby reducing resistance for the movement of the piston 14. Similarly, if the pressure in the high pressure accumulator 30 is too high causing the piston 14 to return to TDC too quickly, the valve 36 can be alternated between operably connecting the third chamber 27C with the high pressure accumulator 30 and the low pressure accumulator 26 thereby reducing the effective fluid pressure of the hydraulic fluid within the third chamber 27C slowing the return of the piston 14.

The operation of valve 36 can be controlled by a control device 38 operably connected by a signal line 40. In an example, a repetitive control 42 can be operatively connected with sensors for determining at least one of piston position, combustion chamber pressure, engine or hydraulic cylinder chamber pressure, combustion chamber temperature, and engine or hydraulic chamber temperature. The repetitive control 42 can also be coupled with the control device 38 or may itself comprise the control device 38. Either of control 42 or control device 38 can include a processor. The present subject matter is directed to the ability to control a free piston engine in both the engine motoring mode and during an engine firing mode to control piston trajectory, including stroke distance and its speed profile over such stroke, including when the piston is firing normally and recovers quickly after an engine misfire.

Figure 9:
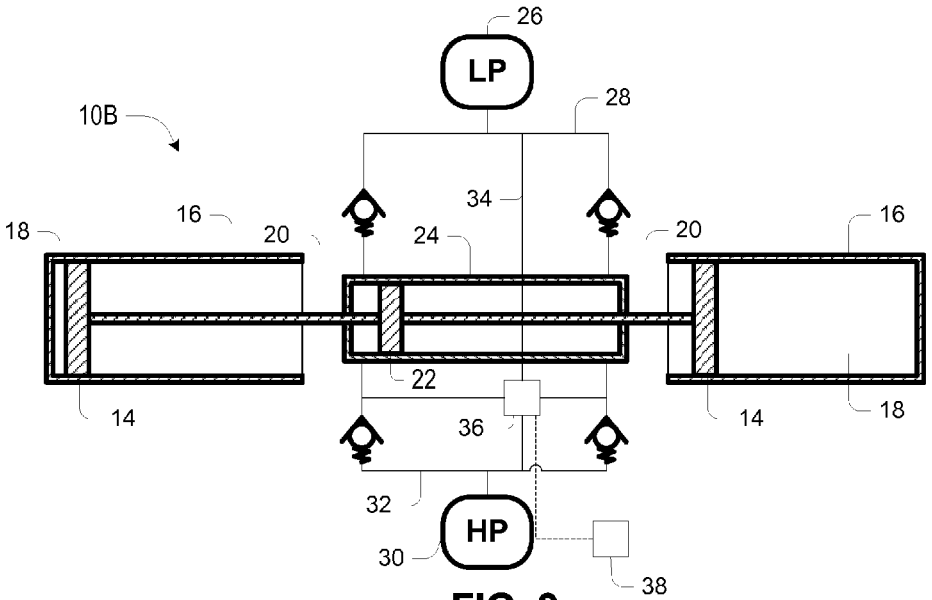
FIG. 9 is a schematic illustration of an opposed chamber architecture for a free piston engine according to an example.

FIG. 9 depicts a dual piston configuration for the hydraulic FP engine 10B. In this configuration, two pistons 14 are sequentially fired within combustion chambers 18 to drive rod 20 connected to plunger 22 of the hydraulic cylinder 24 from opposing sides such that the plunger 22 reciprocates axially between the two cylinders 16. Depending on the particular piston 14 being fired and the corresponding direction of the plunger 22, the low pressure side of the cylinder 24 for that particular piston 14 stroke is connected to a low pressure fluid source 26 by hydraulic line 28. Similarly, the high pressure side of the cylinder 24 for that particular piston 14 stroke is connected to a high pressure accumulator 30 by hydraulic line 32. The hydraulic lines 28 and 32 accommodate the provision of low pressure fluid to either side of the plunger 22 and the outflow of high pressure fluid from the respective side of plunger 22, as controlled by conventional valves. A line 34 operably connects the high pressure line 32 to the low pressure line 28 for transfer of hydraulic fluid between the high pressure side of the hydraulic cylinder 24 and the low pressure side of the hydraulic cylinder 24. A control valve 36 regulates the flow of hydraulic fluid between the high pressure side and the low pressure side. The control valve 36 can be selectively connected to one or more of the different hydraulic chambers in real-time by providing control signals to the control valve 36, or any number of such control valves as operatively arranged. The valve 36 can be controlled by a control device 38 for control of the high and low pressure sides of the hydraulic cylinder 24 or the particular stroke to adjust the dynamics of pistons 14. Control device 38 can include a processor. This arrangement gives flexibility for controlling the trajectory of pistons 14 during both motoring and firing modes.

Figure 10:
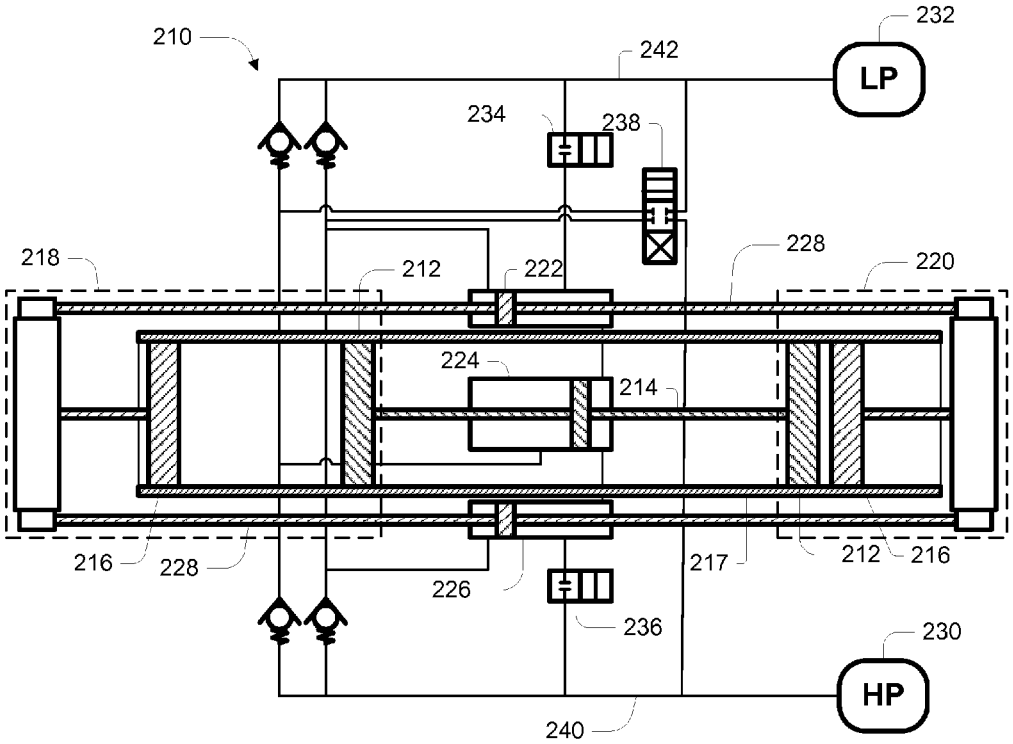
FIG. 10 is a schematic view of a hydraulic FP engine, according to an example.

FIG. 10 depicts an opposed piston and opposed cylinder ("OPOC"), two-stroke configuration for a FP engine 210. As depicted, the FP engine 210 includes a pair of inner pistons 212, a connection rod 214 and a pair of outer pistons 216. The inner pistons 212 are connected by the connection rod 214 such that the inner pistons 212 move independently of the outer pistons 216. Each inner piston 212 corresponds to one outer piston 216 to form a left piston pair 218 and a right piston pair 220.

In an example, the engine can be started, for example, from a bottom dead center ("BDC") position in which an inner piston 212 of the left piston pair 218 is at the maximum distance from the corresponding outer piston 216 as depicted in FIG. 10. Upon combustion within the combustion chamber of the right piston pair 220, the inner piston 212 of the left piston pair 218 moves towards the top dead center ("TDC") position in which the inner piston 212 of the left piston pair 218 is at the minimum distance from the corresponding outer piston 216. For the purposes of this discussion, the BDC positions and the TDC positions of the piston pairs 218, 220 are equivalent to the reversal points of an oscillating piston of a single FP engine, such as depicted in FIG. 8. Similarly, the outer pistons 216 are operably connected by side push rods 228 such that a combustion event in the combustion chamber of the right piston pair 220 pushes the outer piston 216 of the right piston pair 220 away from the inner piston 212 and pulls the outer piston 216 of the left piston pair 218 toward the inner piston 212 of the left piston pair 218. As depicted in FIG. 10, the pistons 212, 216 of the left piston pair 218 are oriented in positions approximating BDC and the pistons 212, 216 of the right piston pair 220 are oriented in positions approximating TDC. As the inner piston 212 and the outer piston 216 of the left piston pair 218 are move toward the TDC position, the gases within the combustion chamber of the left piston pair 218 are compressed for an ignition process such as auto-ignition or spark drive ignition. The second combustion event returns the left piston pair 218 to the BDC position while pushing the right piston pair 220 to the TDC position. The two combustion chambers of the two piston pairs 218, 220 can be fired alternatively to keep the inner pistons 212 and outer pistons 216 moving linearly in a reciprocal fashion.

As depicted in FIG. 10, in an example, the hydraulic block for the FP engine 210 includes a plurality of hydraulic pumps 222, 224, 226. As shown in the figure, the right-hand chambers of pumps 222, 224, and 226 are coupled together by fluid lines. In certain examples, at least two of the hydraulic pumps 222, 226 are each operably connected to the outer pistons 216 by side push rods 228. Similarly, at least one hydraulic pump 224 is operably connected to the inner pistons 212 by the connection rod 214. In an example, inner hydraulic pump 224 has a plunger area equal to the combined plunger area to the outer hydraulic pumps 222, 226.

As depicted in FIG. 10, as the outer piston 216 of the left piston pair 218 is pushed toward the TDC position, hydraulic fluid is pushed from the right chambers of outer hydraulic pumps 222, 226 into a high pressure source or accumulator 230. In this configuration, the kinetic energy of the outer hydraulic pumps 222, 226 is converted into hydraulic energy stored in the high pressure accumulator 230. Similarly, the movement of the inner pistons 212 also causes hydraulic fluid to be drawn into the right chamber of the inner hydraulic pump 224 from a low pressure source or accumulator 232. Upon reversal of movement, the outer piston 216 of the left piston pair 218 move toward the BDC position, hydraulic fluid is pulled into the right chambers of outer hydraulic pumps 222, 226 from the low pressure accumulator 232, wherein a valve 234, sometimes referred to as a Lee valve, is used to control such synchronization. Similarly, a valve 236 directs fluid from the right chamber of the inner hydraulic pump 224 toward the high pressure source 230.

As depicted in FIG. 10, a valve 238, such as a Moog-type valve, can be used to switch between the engine operating modes. That is, between the engine motoring mode, during which hydraulic energy, such as that stored in the high pressure accumulator 230, can be used to influence the pistons 212, 216 to achieve a desired piston trajectory. When the valve 238 is at its bottom position depicted in FIG. 10

(that is, the fluid passages are both open and crossing), high pressure fluid, as hydraulically connected such as illustrated by hydraulic lines 240, is directed into the left chamber of the inner piston pump 224 to push the inner piston 212 of the right piston pair 220 toward TDC and compressing fluid in the right chamber of the inner hydraulic pump 234. The movement of the inner hydraulic pump 224 also causes the outer pump 222, 226 to move to compress fluid in the left chambers in the outer pumps 222, 226. However, when the valve 238 is at its top position depicted in FIG. 10 (lines are open and uncrossed), the hydraulic forces change direction and moves the piston pairs 218, 220 in the opposite direction. The engine is switched to a pumping mode during which the fluid in the hydraulic chambers are pumped into the high pressure accumulator 230 when the valve 238 is at its middle position. The low pressure side is also illustrated with appropriate hydraulic lines 242 to provide fluid as needed on either side of each hydraulic pump 222, 224 and 226 for adjusting the oscillation of the pumps 222, 224 and 226 and correspondingly the oscillation of the left piston pair 218 and the right piston pair 220.

Operation Example

Figure 11A:
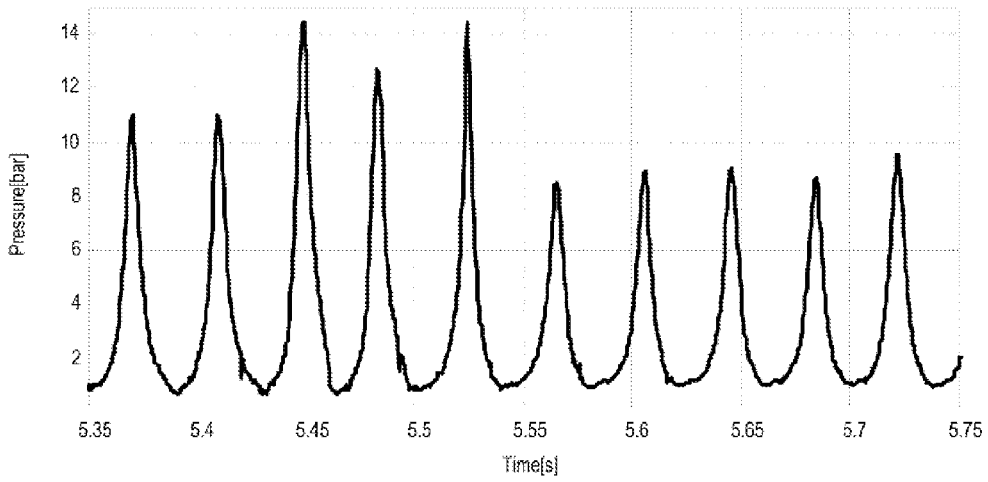
FIG. 11A is a chart illustrating a pressure trace after a single combustion event, under control of an algorithm, according to an example.
Figure 11B:
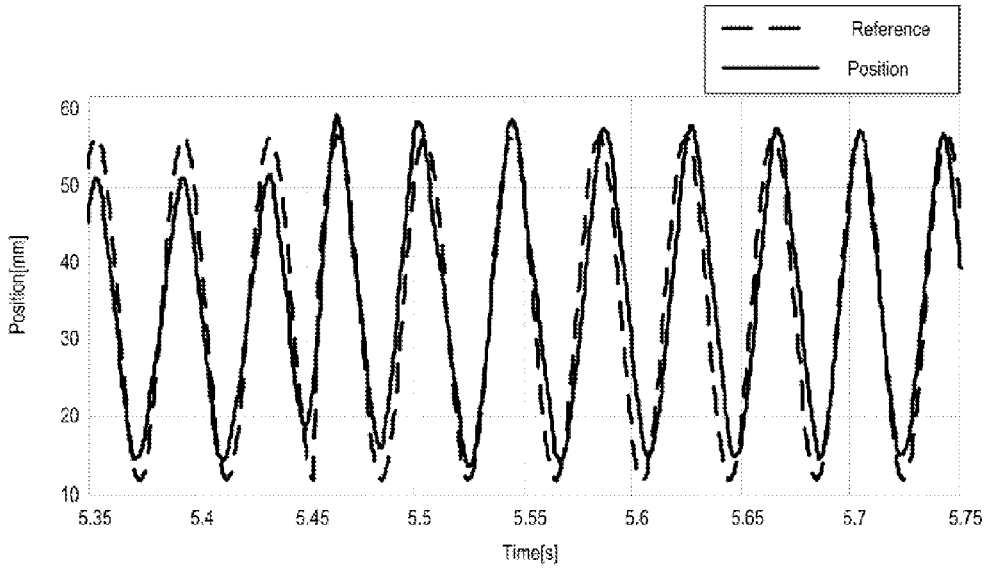
FIG. 11B is a chart illustrating an actual piston trajectory and a reference trajectory after a single combustion event, under control of an algorithm, according to an example.

In an example, a control algorithm according to the present subject matter is implemented on the hydraulic free-piston engine, and the result of single-occurrence combustion on the left combustion chamber, such as depicted in FIG. 10, is depicted in FIGS. 11A-11B. FIG. 11A depicts the pressure within the combustion chamber illustrating ignition detection while FIG. 11B depicts the piston position illustrating a shifted reference trajectory relative to the actual piston trajectory to avoid tracking errors from the combustion event.

Multi-occurrence combustion events having varying combustion conditions validate the robustness of the control algorithm. Due to the design of certain combustion systems, the gas mixing condition of each cycle can vary, which can mean that the combustion timing and combustion strength can also vary. However, the control algorithm is able to detect the transient period following a combustion event and adjust the control signal to avoid excessive tracking errors or an outer-of-phase control signal resulting from a misalignment of the reference trajectory of the control signal from the actual piston trajectory.

Figure 12A:
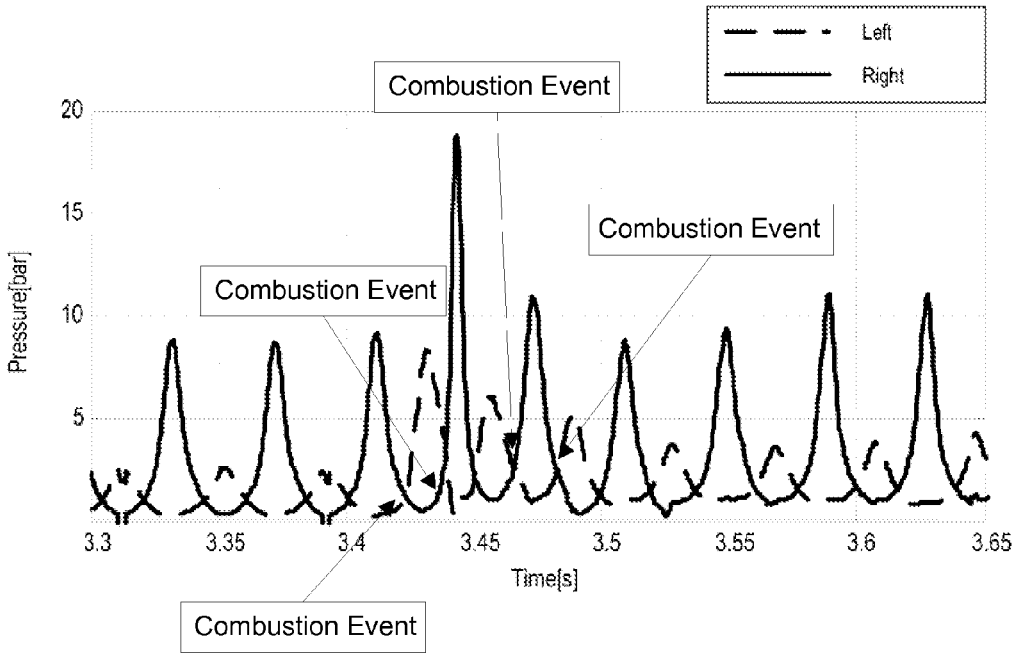
FIG. 12A is a chart illustrating a piston pressure of a dual piston FP engine after a continuous combustion event, under control of an algorithm, according to an example.
Figure 12B:
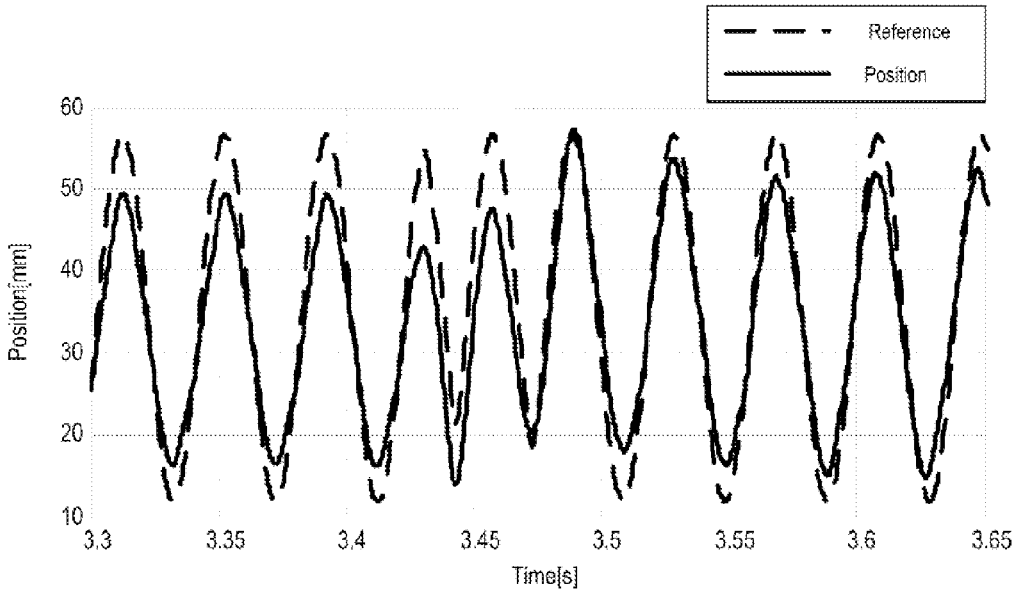
FIG. 12B is a chart illustrating an actual piston trajectory and a reference trajectory after a continuous combustion event, under control of an algorithm, according to an example.

FIGS. 12A-12B depicts the result of firing on both sides of the FP engine 210 such as depicted in FIG. 10. Four injection events were scheduled alternating between the right piston pair 220 and the left piston pair 218. The first combustion occurs at around 3.42 s when right side reaches its TDC, then around 3.44 s when the left piston pair 218 reaches TDC, a second combustion can be observed. The third combustion occurs around 3.46 s, and the last combustion occurs around 3.48 s. The control algorithm disclosed herein detected all four combustion events and applied the reference shifting accordingly, such that the effects of shifting of the actual piston trajectory from the combustion events were minimized and thereby permitting continuous firing.

Each of these non-limiting examples can stand on its own, or can be combined in any permutation or combination with any one or more of the other examples.

The above detailed description includes references to the accompanying drawings, which form a part of the detailed description. The drawings show, by way of illustration, specific embodiments in which the present subject matter can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided, to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the present subject matter should be determined with reference to the appended claims, along with the full scope of equivalents to which such claims are entitled.

What is claimed is:

1. A free-piston engine, comprising:

an oscillating piston travelling along an actual piston trajectory;

a controller configured to:

store a predetermined reference trajectory for controlling oscillation of the piston, compare the actual piston trajectory of the oscillating piston to the stored predetermined reference trajectory, locate a first local extremum for the actual piston trajectory, the first local extremum corresponding to a first actual reversal point for the oscillating piston, record a first time instant corresponding to the first local extremum, detect a first combustion event of the piston by comparing the first time instant to a predetermined first reference time index, the predetermined first reference time index corresponding to a first reference reversal point corresponding to the first actual reversal point, and apply a first reference shift to the stored predetermined reference trajectory upon detecting the first combustion event to digitally shift the stored predetermined reference trajectory by a time interval to create a first shifted reference trajectory, the time interval corresponding to the difference between the first time instant and the predetermined first reference time index;

an engine cylinder for slidably receiving the piston; and a force transducer having a linear actuator coupled to the piston, wherein the controller is coupled to the force transducer and configured to control the oscillation of the linear actuator of the force transducer to influence the piston oscillation such that the actual piston trajectory approximates the stored predetermined reference trajectory prior to the first combustion event and the first shifted reference trajectory following the first combustion event.

2. The free-piston engine of claim 1, wherein the first combustion event is detected when the difference between the first time instant and the predetermined first reference time index exceeds a predetermined threshold that corresponds to the stored predetermined reference trajectory.

3. The free-piston engine of claim 1, wherein the controller is further configured to:

monitor acceleration of the piston following the first time instant.

4. The free-piston engine of claim 3, wherein the controller is further configured to:

monitor acceleration of the piston through a plurality of non-combustion piston cycles;

compare acceleration of the piston following the first time instant to prior piston accelerations for a non-combustion cycle; and validate the detection of the first combustion event found by the difference between the first time instant and the predetermined first reference time index if the piston acceleration following the first time instant exceeds the piston accelerations of the non-combustion cycles.

5. The free-piston engine of claim 3, wherein the controller is further configured to:

apply a correction to the first shifted reference trajectory corresponding to the acceleration of the piston;

wherein the correction is one of modifying amplitude of the first shifted reference trajectory, modifying magnitude of the first shifted reference trajectory and combinations thereof.

6. The free-piston engine of claim 1, further comprising:

a sensor configured to detect the first combustion event within the engine cylinder and notify the controller of the detected first combustion event.

7. The free-piston engine of claim 6, wherein the sensor is configured to detect combustion by monitoring at least one of intake port pressure, exhaust port pressure, and location of the piston.

8. The free-piston engine of claim 6, wherein the sensor is configured to:

detect the strength of the first combustion event based on at least one of pressure generated by combustion, piston velocity following combustion, piston acceleration and combinations thereof;

wherein the controller is configured to control the force transducer in a subsequent piston cycle to compensate for the detected strength.

9. The free-piston engine of claim 8, wherein the controller is further configured to:

control the force transducer to compensate for the detected strength, and determine whether to influence a position of the piston in association with the first shifted reference trajectory by comparing the detected strength to a strength associated with the first shifted reference trajectory.

10. The free-piston engine of claim 1, wherein the controller is configured to:

locate a second local extremum for the actual piston trajectory, the second local extremum corresponding to a second actual reversal point;

record a second time instant corresponding to the second local extremum;

detect a second combustion event by comparing the second time instant to a second reference time index, the second reference time index corresponding to a second reference reversal point corresponding to the second actual reversal point; and apply a second reference shift to the first shifted reference trajectory upon detecting of the second combustion event to create a second shifted reference trajectory, the second reference shift corresponding to the difference between the second time instant and the second reference time index.

11. The free-piston engine of claim 10, further comprising:

a sensor configured to monitor cylinder pressure of the engine cylinder for at least two combustion events;

wherein the controller is further configured to:

compare a second cylinder pressure of the second combustion event to a cylinder pressure of the first combustion event, wherein the second combustion event is subsequent to the first combustion event: and update the second reference shift by a factor corresponding to the difference between the cylinder pressure and the second cylinder pressure.

12. The free-piston engine of claim 1, further comprising an energy storage device coupled to the force transducer to store energy generated by movement of the piston.

13. The free-piston engine of claim 12, wherein the force transducer comprises a linear alternator and the energy storage device comprises a battery.

14. The free-piston engine of claim 12, wherein the force transducer comprises a hydraulic pump, and the piston is connected with a plunger of the hydraulic pump and the hydraulic pump is coupled with the energy storage device.

15. The free-piston engine of claim 14, wherein the energy storage device comprises a high pressure fluid source connected with the hydraulic pump on one side thereof while a low pressure fluid source is connected with another side of the hydraulic pump.

16. The free-piston engine of claim 15, wherein the controller is coupled to at least one valve configured to place high pressure fluid stored in the high pressure source in fluid communication with at least one hydraulic chamber of the hydraulic pump.

17. The free-piston engine of claim 16, wherein a control valve can place either of the low pressure fluid source and the high pressure fluid source to a plurality of chambers of the hydraulic pump.

18. The free-piston engine of claim 1, wherein the controller is further configured to:

record an error signal corresponding to the difference between the actual piston trajectory and the first shifted reference trajectory; and generate a control signal for the force transducer to minimize the error signal.

19. The free-piston engine of claim 18, wherein the controller is further configured to:

apply the first reference shift to the error signal and the control signal.

20. A method comprising:

reciprocating a piston in an engine cylinder to displace a force transducer, wherein the piston travels along an actual piston trajectory;

storing a predetermined reference trajectory in a controller, the predetermined reference trajectory used for controlling oscillation of the piston;

monitoring engine operation by comparing actual piston trajectory of an oscillating piston to the predetermined reference trajectory;

locating a first local extremum for the actual piston trajectory, the first local extremum corresponding to a first actual reversal point of the reciprocating piston;

recording a first time instant corresponding to the first local extremum;

comparing the first time instant to a predetermined first reference time index to detect a first combustion event of the piston, the predetermined first reference time index corresponding to a first reference reversal point corresponding to the first actual reversal point;

applying a first reference shift to the predetermined reference trajectory upon detecting of the first combustion event to digitally shift the predetermined reference trajectory by a first time interval to create a first shifted reference trajectory, the first time interval corresponding to the difference between the first time instant and the predetermined first reference time index; and operating the force transducer to influence the actual piston trajectory to approximate the first shifted reference trajectory following the first combustion event.

21. The method of claim 20, wherein the first combustion event is detected when the difference between the first time instant and the predetermined first reference time index exceeds a predetermined threshold that corresponds to the stored predetermined reference trajectory.

22. The method of claim 20, further comprising:

monitoring acceleration of the piston following the first time instant.

23. The method of claim 22, further comprising:

monitoring acceleration of the piston through a plurality of non-combustion piston cycles;

comparing acceleration of the piston following the first time instant to prior piston accelerations for piston non-combustion cycles; and confirming detection of the combustion event if acceleration of the piston following the first time instant exceeds the prior piston accelerations.

24. The method of claim 22, wherein the controller is further configured to:

apply a correction to the first shifted reference trajectory corresponding to the acceleration of the piston;

wherein the correction is one of modifying amplitude of the first shifted reference trajectory, modifying magnitude of the first shifted reference trajectory and combinations thereof.

25. The method of claim 20, further comprising;

detecting combustion in the cylinder by monitoring at least one of intake port pressure, exhaust port pressure, and location of the piston.

26. The method of claim 20, further comprising:

locating a second local extremum for the actual piston trajectory, the second local extremum corresponding to one of a second actual reversal point;

recording a second time instant corresponding to the second local extremum;

detecting a second combustion event by comparing the second time instant to a second reference time index, the second reference time index being a second time interval corresponding to a second reference reversal point corresponding to the actual reversal point; and applying a second reference shift to the first shifted reference trajectory upon detecting of the second combustion event to create a second reference trajectory, the second reference shift corresponding to the difference between the second time instant and the second reference time index.

27. The method of claim 26, further comprising:

comparing a second cylinder pressure of the second combustion event to a cylinder pressure of the first combustion event, wherein the second combustion event is subsequent to the first combustion event;

updating the second reference shift by a factor corresponding to the difference between the cylinder pressure and the second cylinder pressure.

28. The method of claim 20, further comprising:

detect the strength of the first combustion event based on at least one of pressure generated by combustion, piston velocity following combustion, piston acceleration and combinations thereof; and controlling the force transducer in a subsequent piston cycle to compensate for the detected strength.

29. The method of claim 28, further comprising:

controlling the force transducer to compensate for the detected strength, and determining whether to influence a position of the piston in association with the first shifted reference trajectory by comparing the detected strength to a strength associated with the first shifted reference trajectory.

30. The method of claim 20, further comprising:

recording an error signal corresponding to the difference between the actual piston trajectory and the first shifted reference trajectory; and generating a control signal for the force transducer to minimize the error signal.

31. The method of claim 30, further comprising:

applying the first reference shift to the error signal and the control signal.

* * * * *